US007482752B2

(12) United States Patent
Kang et al.

(10) Patent No.: US 7,482,752 B2
(45) Date of Patent: Jan. 27, 2009

(54) PLASMA DISPLAY PANEL WITH ELECTRODE PAIRS AT DISPLAY AND NON-DISPLAY REGIONS, EACH PAIR HAVING A DIFFERENT SEPARATION GAP ON EACH REGION

(75) Inventors: Seok Dong Kang, Gumi-Si (KR); Gi Bum Lee, Changwon-si (KR); Jae Young Oh, Taegu-si (KR); Hong Tak Kim, Taegu-si (KR)

(73) Assignee: LG Electronics Inc., Seoul (KR)

( * ) Notice: Subject to any disclaimer, the term of this patent is extended or adjusted under 35 U.S.C. 154(b) by 146 days.

(21) Appl. No.: 11/334,736

(22) Filed: Jan. 19, 2006

(65) Prior Publication Data

US 2006/0158119 A1 Jul. 20, 2006

(30) Foreign Application Priority Data

Jan. 20, 2005 (KR) ..... 10-2005-0005563
Mar. 30, 2005 (KR) ..... 10-2005-0026557

(51) Int. Cl.
*H01J 17/49* (2006.01)

(52) U.S. Cl. ..... 313/584; 313/582; 315/169.4; 315/169.1

(58) Field of Classification Search ..... 313/582–587; 315/169.1, 169.4; 345/37, 41, 60, 71
See application file for complete search history.

(56) References Cited

U.S. PATENT DOCUMENTS 5,107,176 A * 4/1992 Endo et al. ..... 313/583
5,587,624 A * 12/1996 Komaki ..... 313/584
5,661,500 A 8/1997 Shinoda et al. ..... 345/60
6,469,441 B1 * 10/2002 Choi ..... 313/583
6,479,932 B1 * 11/2002 Nunomura ..... 313/582
6,603,263 B1 * 8/2003 Hashimoto et al. ..... 313/584
6,646,375 B1 11/2003 Nagano ..... 313/582
6,825,606 B2 * 11/2004 Schermerhorn et al. ..... 313/484
7,071,621 B1 * 7/2006 Namiki et al. ..... 313/584
2003/0090212 A1 * 5/2003 Park et al. ..... 315/169.1
2004/0051456 A1 3/2004 Kim ..... 313/582
2004/0113554 A1 * 6/2004 Kim et al. ..... 313/582
2004/0130269 A1 * 7/2004 Park ..... 313/586

(Continued)

FOREIGN PATENT DOCUMENTS

EP 1 313 124 A2 5/2003

(Continued)

OTHER PUBLICATIONS

Korean Office Action dated Aug. 29, 2006.

(Continued)

*Primary Examiner*—Mariceli Santiago
(74) *Attorney, Agent, or Firm*—Ked & Associates, LLP

(57) ABSTRACT

In a plasma display panel, a space between a pair of sustain electrodes of a non-valid screen is different from a space between a pair of sustain electrodes of a valid screen. Accordingly, when discharges occur, impurities present inside the plasma display panel can be attached on the sustain electrodes of the non-valid screen, and thus, occurrence of an erroneous discharge at the valid screen can be prevented.

27 Claims, 7 Drawing Sheets

U.S. PATENT DOCUMENTS

| | | | | |
|---|---|---|---|---|
| 2004/0135507 | A1* | 7/2004 | Park et al. | 313/582 |
| 2005/0029945 | A1* | 2/2005 | Hwang | 313/583 |
| 2005/0236994 | A1* | 10/2005 | Kwon et al. | 313/584 |
| 2006/0097649 | A1* | 5/2006 | Kim et al. | 315/169.4 |
| 2006/0113920 | A1* | 6/2006 | Choi et al. | 315/169.3 |
| 2007/0024194 | A1* | 2/2007 | Kim | 313/582 |

FOREIGN PATENT DOCUMENTS

| | | | |
|---|---|---|---|
| JP | 05-114362 | | 5/1993 |
| JP | 2003-346664 | | 12/2003 |
| JP | 2004103562 | A * | 4/2004 |
| KR | 10-2002-0041752 | A | 6/2002 |

OTHER PUBLICATIONS

Korean Office Action dated Sep. 15, 2006.
European Search Report dated Jan. 23, 2008.
Chinese Office Action dated Sep. 19, 2008.

* cited by examiner

PLASMA DISPLAY PANEL WITH ELECTRODE PAIRS AT DISPLAY AND NON-DISPLAY REGIONS, EACH PAIR HAVING A DIFFERENT SEPARATION GAP ON EACH REGION

BACKGROUND OF THE INVENTION

1. Field of the Invention

The present invention relates to a plasma display panel (PDP) and, more particularly, to a structure of electrodes formed on a non-valid screen of the panel and a PDP with the electrodes formed thereon.

2. Description of the Related Art

A plasma display apparatus is an apparatus in which discharge cells are formed between a rear substrate with barrier ribs formed thereon and a front substrate facing the rear substrate, and when an inert gas inside each discharge cell is discharged by a high frequency voltage, vacuum ultraviolet rays are generated to illuminate phosphor to thereby allow displaying of images.

FIG. 1 is a plan view showing electrodes formed on a general PDP, and FIG. 2 is a sectional view showing a discharge cell of the general PDP.

To begin with, discharge cells are formed by a plurality of barrier ribs 24 separating a discharge space on a rear substrate 18 facing a front substrate 10.

An address electrode 12X is formed on the rear substrate 18, and a scan electrode 12Y and a sustain electrode 12Z are formed as a pair on the front substrate 10.

As shown in FIG. 1, the address electrode 12X crosses the other electrodes, and in this respect, the rear substrate 18 in FIG. 2 is shown as having been rotated by 90° for the sake of explanation.

A dielectric layer 22 for accumulating wall charges is formed on the rear substrate 18 with the address electrode 12X formed thereon.

The barrier ribs 24 are formed on the dielectric layer 22 to define a discharge space therebetween and prevent a leakage of ultraviolet rays and visible light generated by a discharge to an adjacent discharge cell. Phosphor 20 is coated on the surface of the dielectric layer 22 and on the surface of the barrier ribs 24.

Because an inert gas is injected into the discharge space, the phosphor 20 is excited by the ultraviolet rays generated during a gas discharge to generate one of red, green and blue visible light.

The scan electrode 12Y and the sustain electrode 12Z formed on the front substrate 10 include transparent electrodes 12*a* and bus electrodes 12*b*, respectively, and cross the address electrode 12X.

A dielectric layer 14 and a protective film 16 are formed to cover the scan electrode 12Y and the sustain electrode 12Z.

The discharge cell with such a structure is selected by a facing discharge formed between the address electrode 12X and the scan electrode 12Y, and the discharge is sustained by a surface discharge between the scan electrode 12Y and the sustain electrode 12Z, to thus emit visible light.

FIG. 3 is a front view of the general PDP.

The PDP includes an exhaust tip (T) formed at an outermost portion thereof to exhaust impurities present inside the panel during an exhausting process. In this respect, however, in the exhausting process, impurities may not be completely exhausted out of the panel but remain around the exhaust tip (T) to contaminate a cell.

To avoid such a problem, contamination preventing cells (D) are formed at a non-valid screen (B) outside a valid screen (A) on which an image is displayed, to induce contamination generated by the impurities that have not been exhausted thereto.

However, because a bus electrode and a transparent electrode are not formed on the non-valid screen (B) with the contamination preventing cells (D) formed thereon, impurities present inside the contamination preventing cells (D) affect discharge cells of the valid screen (A), which may cause an erroneous discharge that generates unwanted spots and flashes.

In particular, metal impurities such as Pb, Ca and Na are adhered onto the dielectric layer made of MgO, which reduce the surface resistance of the dielectric layer and cancel out wall charges during the discharge, which causes illumination failures, and as a result, the driving voltage to make sure that discharges occur properly must be increased.

SUMMARY OF THE INVENTION

The present invention is designed to solve such problem of the related art, and therefore, an object of the present invention is to provide a plasma display panel (PDP) in which a space (distance) between third and fourth electrodes of a non-valid screen is different from a space between first and second electrodes of a valid screen so that when a discharge occurs, impurities present inside the PDP can be attached onto the third and fourth electrodes of the non-valid screen, thereby preventing occurrence of an erroneous discharge at the valid screen.

When the third and fourth electrodes of the non-valid screen are formed of transparent electrodes, the space between the pair of the third and fourth electrodes is longer than the space of the pair of transparent electrodes of the valid screen, by 1.2 times to 4 times (namely, by 120 μm~180 μm).

The space between the third and fourth electrodes of the non-valid screen may be longer by 1.5 times than the space between the first and second electrodes of the valid screen.

The width of the third and fourth electrodes of the non-valid screen may be smaller than that of the first and second electrodes of the valid screen, and the third and fourth electrodes of the non-valid screen may have a narrow vertical width, respectively.

The third and fourth electrodes of the non-valid screen include an opening at a position corresponding to a discharge cell, and a horizontal width of the opening may be larger than a horizontal width of the discharge cell formed at the non-valid screen.

Openings may be formed at portions of the third and fourth electrodes of the non-valid screen where barrier ribs cross, and a horizontal width of an upper end portion of the opening may be different from that of a lower end portion of the opening.

Herein, the horizontal width may be increased as it goes toward an outer side of the non-valid screen, and may not be larger than the horizontal width of the discharge cell.

In addition, one or more holes may be formed in the third and fourth electrodes of the non-valid screen.

According to the present invention, there is provided a plasma display panel (PDP) divided into a valid screen and a non-valid screen positioned at an outer side of the valid screen, in which a width of first and second transparent electrodes formed to face each other at the valid screen is different from a width of third and fourth transparent electrodes formed to face each other at the non-valid screen.

In the PDP, a horizontal width of the third and fourth transparent electrodes is smaller than that of the first and second transparent electrodes, and a vertical width of the third and fourth transparent electrodes is smaller than that of the first and second transparent electrodes.

According to the present invention, there is also provided a plasma display panel comprising: a substrate; and scan electrodes and sustain electrodes formed on the substrate, in which a space between the scan electrodes and the sustain electrodes formed at a first area of the substrate is different from a space between the scan electrodes and the sustain electrodes formed at a second area of the substrate.

In the PDP, the first area is positioned at the valid screen area and the second area is positioned at the non-valid screen area positioned at the outer side of the valid screen area.

In the PDP, the space between the scan electrodes and the sustain electrodes formed at the first area is longer than that between the scan electrodes and sustain electrodes formed at the second area.

In the PDP, the space between the scan electrodes and the sustain electrodes formed at the first area is longer than that between the scan electrodes and sustain electrodes formed at the second area by 1.2 times to 4 times.

In the PDP, the scan electrodes and the sustain electrodes are transparent electrodes.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

The structure of electrodes formed on a non-valid screen and a plasma display panel (PDP) having such an electrode structure in accordance with the present invention will now be described with reference to the accompanying drawings.

There can be a plurality of embodiments of the PDP in accordance with the present invention, the most preferred ones of which will now be described.

Figure 1:
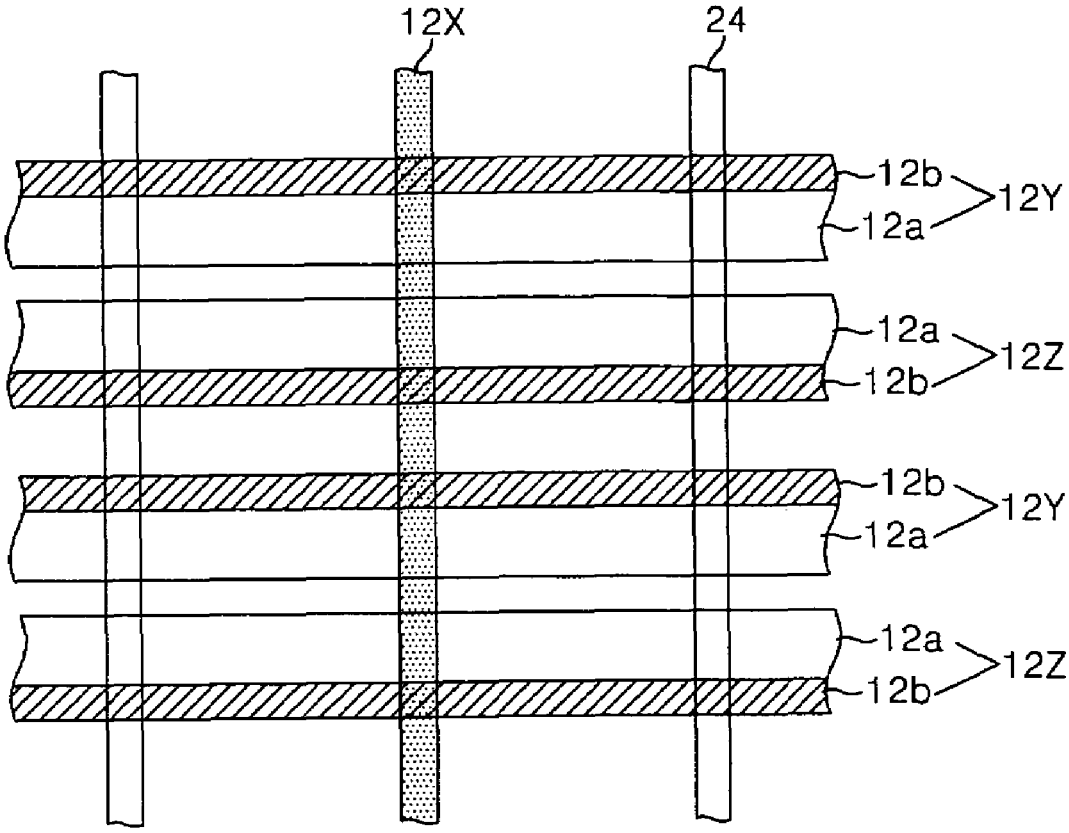
FIG. 1 (Prior Art)
FIG. 1 is a plan view of electrodes formed on a general plasma display panel (PDP).
Figure 2:
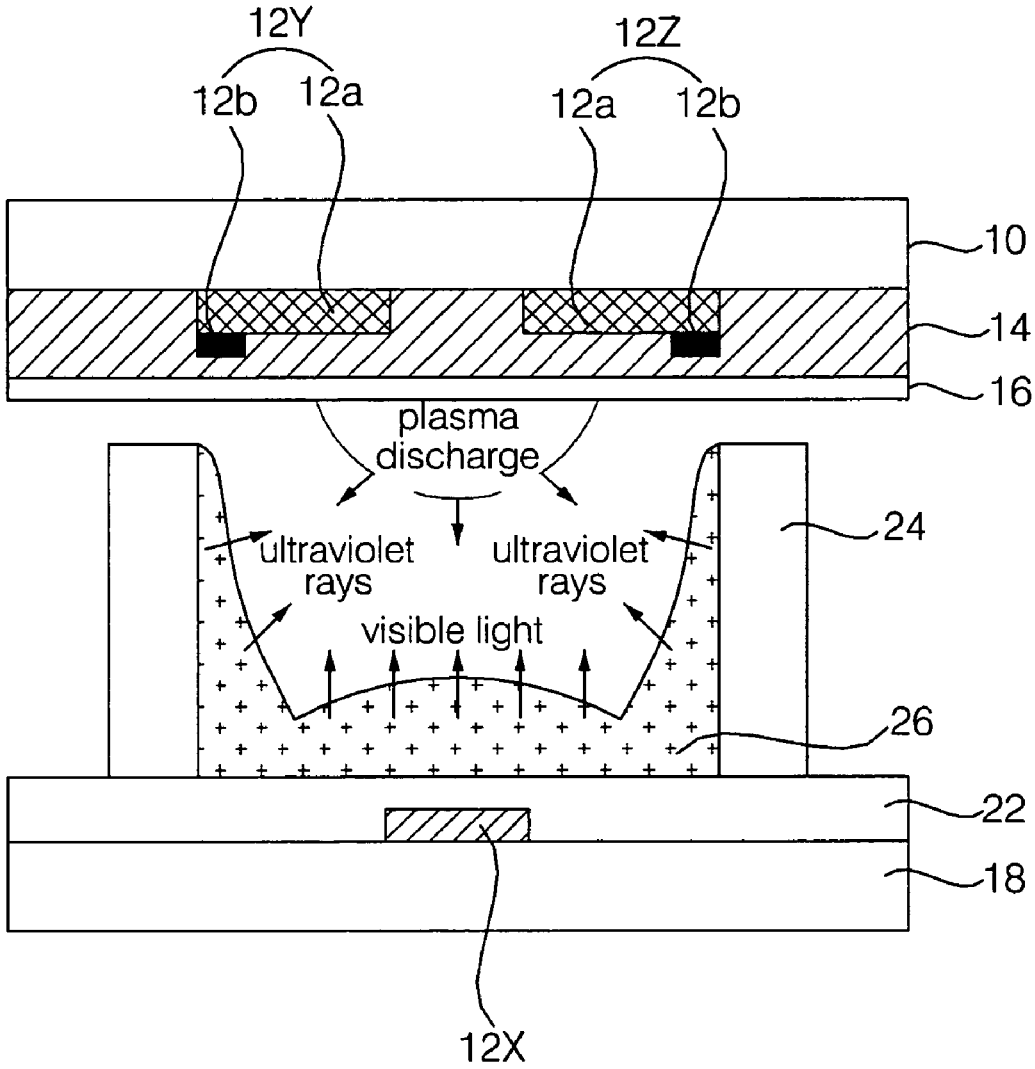
FIG. 2 (Prior Art)
FIG. 2 is a sectional view of a discharge cell of the general PDP.
Figure 3:
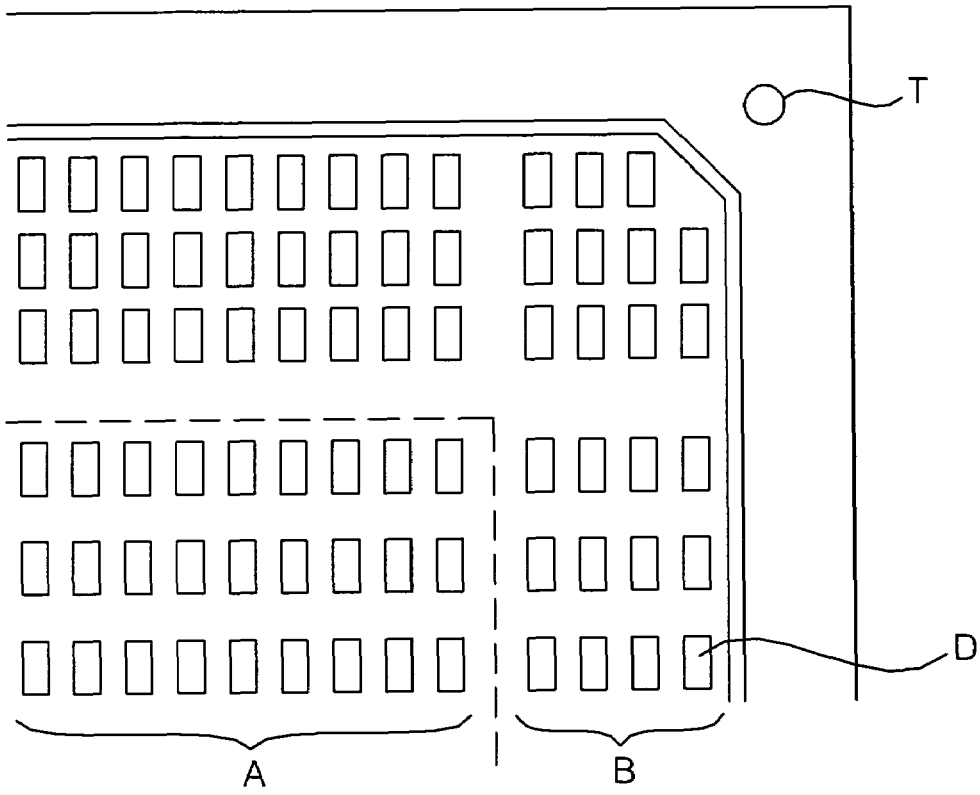
FIG. 3 (Prior Art)
FIG. 3 is a front view of the general PDP.
Figure 4:
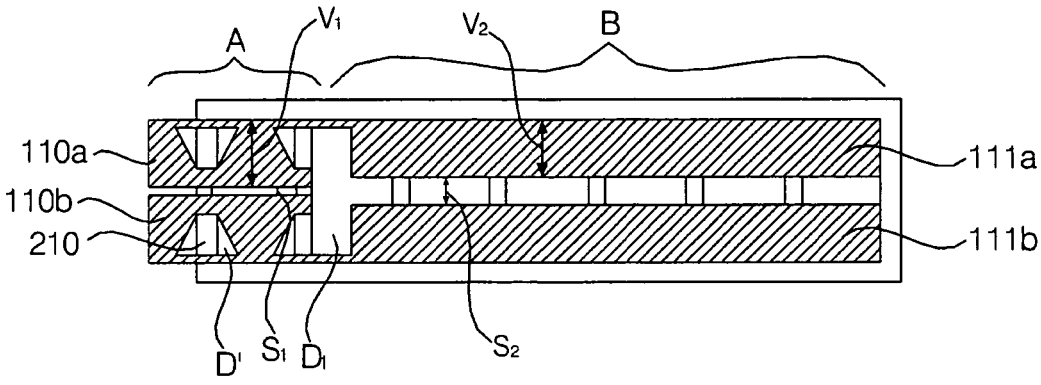
FIG. 4 illustrates a PDP in accordance with a first embodiment of the present invention.

FIG. 4 illustrates the structure of a PDP in accordance with a first embodiment of the present invention, in which a space ($S_2$) between third and fourth electrodes 111*a* and 111*b* of a non-valid screen (B) is larger than a space ($S_1$) between first and second electrodes 110*a* and 110*b* of a valid screen (A).

In the case where the space ($S_2$) between the third and fourth electrodes 111*a* and 111*b* of the non-valid screen is larger than the space ($S_1$) between the first and second electrodes 110*a* and 110*b* of the valid screen (A), a driving voltage required for making a discharge occur must be increased.

In the PDP, during an aging process in which a high voltage is applied, a discharge occurs both at the non-valid screen (B) and at the valid screen (A), and at this time, contaminants are induced toward the third and fourth electrodes 111*a* and 111*b* of the non-valid screen (B).

Meanwhile, in driving the general PDP, when a driving voltage of 170V~180V is applied to display a screen, no discharge occurs at the non-valid screen (B) and metal impurities such as Pb, Na, Ca, or the like, are exhausted through the exhaust tip (T).

Here, since the impurities are usually collected at the end of the electrode, many impurities gather around the exhaust tip (T). In addition, when impurities are not completely exhausted during an exhausting process, the impurities which have not been exhausted during the exhausting process are adhered on the third and fourth electrodes 111*a* and 111*b* of the non-valid screen (B) during the aging process.

A driving voltage to make sure that the discharge occur in the PDP is 170V~180V, and during the aging process, a high voltage of 250V or higher is applied to make the discharge occur.

Thus, when the space ($S_2$) between the third and fourth electrodes 111*a* and 111*b* of the non-valid screen (B) is larger than the space ($S_1$) between the first and second electrodes 110*a* and 110*b* of the valid screen (A), the discharge occurs at the third and fourth electrodes 111*a* and 111*b* only during the aging process. And when the PDP is driven to display an image on the screen, the discharge does not occur at the third and fourth electrodes 111*a* and 111*b*.

If the space ($S_2$) between the third and fourth electrodes 111*a* and 111*b* of the non-valid screen (B) is too small, even when the PDP is driven to display an image on the screen, the discharge would occur at the third and fourth electrodes 111*a* and 111*b*.

Therefore, in order to make the discharge occur only when a voltage of 250V or higher is applied like in the aging process, the space ($S_2$) between the third and fourth electrodes 111*a* and 111*b* provided at the non-valid screen (B) must be larger by 1.5 times or more than the space ($S_1$) between the first and second electrodes 110*a* and 110*b* of the valid screen (A).

In this respect, however, if the space ($S_2$) between the third and fourth electrodes 111*a* and 111*b* of the non-valid screen (B) is too large, a driving voltage must be increased accordingly to make the discharge occur at the third and fourth electrodes 111*a* and 111*b* during the aging process. That is, the aging process would not occur without increasing the driving voltage.

Therefore, it is preferred that the space between the third and fourth electrodes 111*a* and 111*b* of the non-valid screen (B) is not larger by 5 times than the space (S1) between the first and second electrodes 110*a* and 110*b* of the valid screen (A).

If a vertical width of the electrodes is increased, capacitance would be increased, so the driving voltage can be lowered. Thus, a vertical width ($V_2$) of the third and fourth electrodes 111*a* and 111*b* of the non-valid screen (B) needs to be smaller than a vertical width ($V_1$) of the first and second electrodes 110*a* and 110*b* of the valid screen (A).

In particular, if the area of the third and fourth electrodes 111*a* and 111*b* formed at a discharge cell ($D_1$), among discharge cells (D) of the non-valid screen (B), which contacts with the valid screen (A) is smaller than the area of electrodes of different discharge cells, the driving voltage must be further increased to make the discharge occur.

Accordingly, when the PDP is driven, because no discharge occurs at the discharge cell contacting with the valid screen, weakening of the discharge of the valid screen can be prevented.

In addition, when the PDP is driven and the discharge occurs at the valid screen (A), particles generated from the outermost discharge cell (D') of the valid screen during the discharge cannot go over to the discharge cell ($D_1$), among the discharge cells (D) of the non-valid screen (B), which contacts with the valid screen (A), thus preventing occurrence of a discharge at the discharge cell ($D_1$).

In detail, when the area of the third and fourth electrodes 111*a* and 111*b* of the discharge cell ($D_1$) contacting with the valid screen (A) among the discharge cells of the non-valid screen (B) is small, wall charges that can be collected at the third and fourth electrodes 111*a* and 111*b* during the driving of the PDP are limited, so the discharge does not occur.

The first to fourth electrodes 110*a*, 110*b*, 111*a* and 111*b* can be a scan electrode, a sustain electrode and a transparent formed on a front substrate of the PDP.

Figure 5:
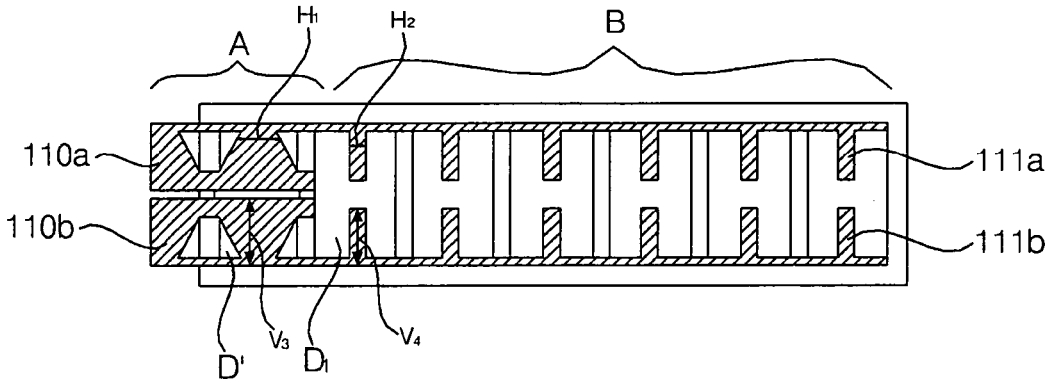
FIG. 5 illustrates a PDP in accordance with a second embodiment of the present invention.

FIG. 5 shows the structure of a PDP in accordance with a second embodiment of the present invention.

As shown in FIG. 5, a horizontal width ($H_2$) of the third and fourth electrodes 111*a* and 111*b* of the non-valid screen (B) can be smaller than a horizontal width ($H_1$) of the first and second electrodes 110*a* and 110*b* of the valid screen (A), and a vertical width ($V_4$) of the third and fourth electrodes 111*a* and 111*b* can be smaller than a vertical width ($V_3$) of the first and second electrodes 111*a* and 111*b*.

In the case where the horizontal width ($H_2$) and the vertical width ($V_4$) of the third and fourth electrodes formed at the non-valid screen (B) are smaller than the horizontal width ($H_1$) and the vertical width ($V_3$) of the first and second electrodes 110*a* and 110*b* formed at the valid screen (A), the area of the third and fourth electrodes 111*a* and 111*b* becomes smaller than the area of the first and second electrodes 110*a* and 110*b*.

Accordingly, when the PDP is actually driven, the amount of wall charges collected at the third and fourth electrodes 111*a* and 111*b* is smaller than those collected at the first and second electrodes 110*a* and 110*b*, so the discharge weakens at the non-valid screen (B), not affecting the screen display.

The first to fourth electrodes 110*a*, 110*b*, 111*a* and 111*b* can be the scan electrode, the sustain electrode and the transparent electrode formed on the front substrate of the PDP.

Figure 6:
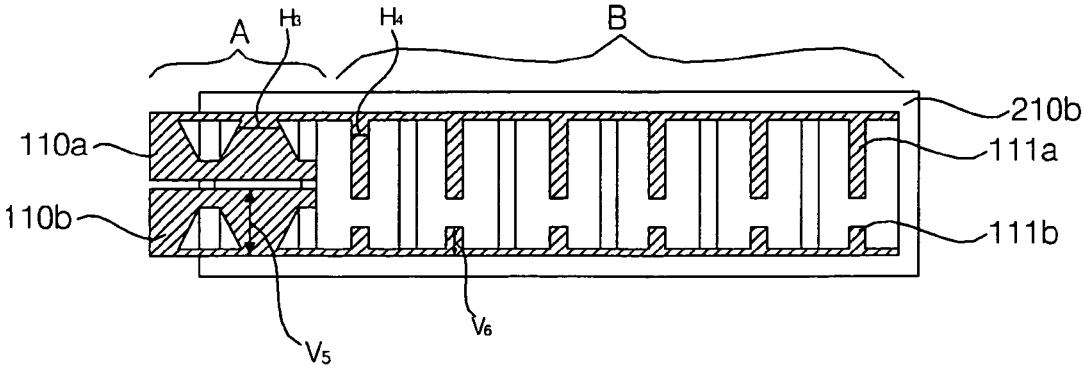
FIG. 6 illustrates a PDP in accordance with a third embodiment of the present invention.

FIG. 6 illustrates the structure of a PDP in accordance with a third embodiment of the present invention.

As shown in FIG. 6, a horizontal width ($H_4$) of the third and fourth electrodes 111*a* and 111*b* formed at the non-valid screen (B) is smaller than a horizontal width ($H_3$) of the first and second electrodes 110*a* and 110*b* formed at the valid screen (A), and the third electrode 111*a* is formed to be longer than the fourth electrode 111*b* formed at its lower side.

In addition, the upper third and lower fourth electrodes 111*a* and 111*b* can be formed to have a different length, respectively, so that a vertical width ($V_6$) of the fourth electrode 111*b* formed at the lower portion of the non-valid screen (B) can be smaller than a vertical width ($V_5$) of the second electrode 110*b* of the valid screen (A).

The discharge of the PDP occurs at the side of the barrier ribs 210. Thus, since the vertical width ($V_6$) of the fourth electrode 111*b* is smaller than the vertical width of the third electrode 111*a*, a discharge generating near a horizontal barrier rib 210*b* of a lower end portion of a cell where the fourth electrode 111*b* with the smaller vertical width ($V_6$) is formed spreads toward the third electrode 111*a*, weakening the discharge.

The first to fourth electrodes 110*a*, 110*b*, 111*a* and 111*b* can be the scan electrode, the sustain electrode and the transparent electrode formed on the front surface of the PDP.

Figure 7:
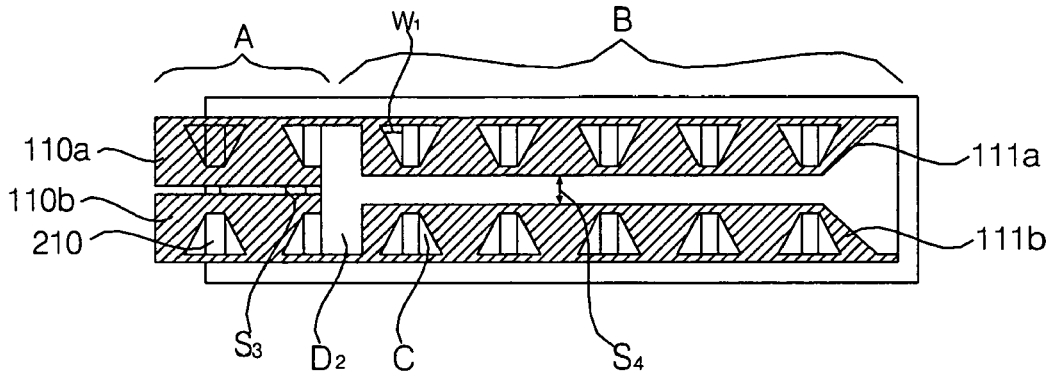
FIG. 7 illustrates a PDP in accordance with a fourth embodiment of the present invention.

FIG. 7 illustrates the structure of a PDP in accordance with a fourth embodiment of the present invention.

As shown in FIG. 7, openings (C) are formed at portions of the third and fourth electrodes 111*a* and 111*b* formed at the non-valid screen (B) where the barrier ribs 210 cross, and each width ($W_1$) of upper and lower portions thereof can be different.

In this case, because a space ($S_4$) between the third and fourth electrodes 111*a* and 111*b* of the non-valid screen (B) is larger than a space ($S_3$) between the first and second electrodes 110*a* and 110*b* of the valid screen (A), the area of the third and fourth electrodes 111*a* and 111*b* becomes smaller than the area of the first and second electrodes 110*a* and 110*b*, so wall charges are limited at the third and the fourth electrodes 111*a* and 111*b* and thus no discharge occurs.

When the area of the electrodes becomes small, a driving voltage for driving the PDP must be increased.

Thus, since the area of the third and fourth electrodes 111*a* and 111*b* is smaller than the area of the first and second electrodes 110*a* and 110*b*, the driving voltage required to make sure that the discharge occur at the non-valid screen (B) must be increased, so no discharge occurs at the non-valid screen (B).

Also, in this case, the area of the third and fourth electrodes 111*a* and 111*b* formed at a discharge cell ($D_2$) contacting with the valid screen (A), among discharge cells of the non-valid screen (B), must be smaller than the area of electrodes of other discharge cells.

The first to fourth electrodes 110*a*, 110*b*, 111*a* and 111*b* can be the scan electrode, the sustain electrode and the transparent electrode formed on the front surface of the PDP.

Figure 8:
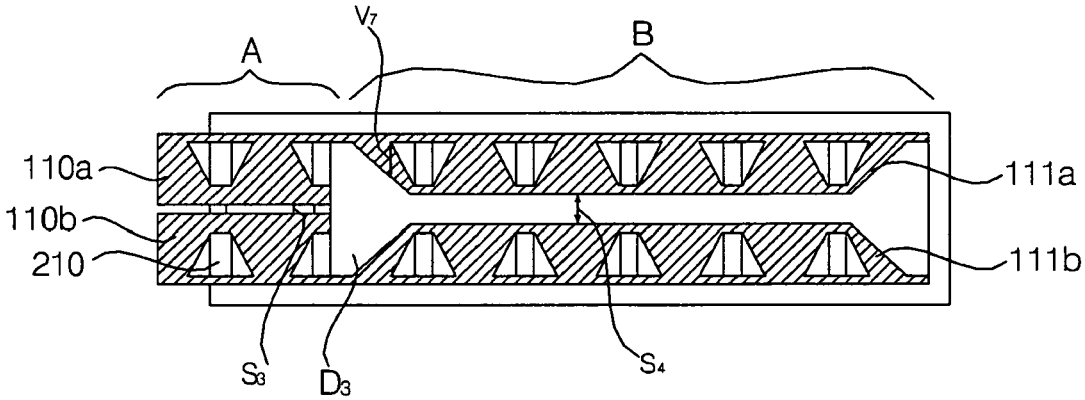
FIG. 8 illustrates a PDP in accordance with a fifth embodiment of the present invention.

FIG. 8 illustrates the structure of a PDP in accordance with a fifth embodiment of the present invention.

As shown in FIG. 8, a sustain electrode formed at a discharge cell ($D_3$), among discharge cells of the non-valid screen (B), which contacts with the valid screen (A) can be formed such that its vertical width (V7) is reduced as it goes toward an outer side of the PDP.

Here, the space between the third and fourth electrodes 111*a* and 111*b* formed at the discharge cell ($D_3$) of the non-valid screen (B) contacting with the valid screen (A) is increased as it goes toward an edge of the PDP.

Accordingly, in order to make the discharge occur at the discharge cell ($D_3$), the driving voltage must be increased. In this respect, however, since a voltage of about 180V is applied to display an image on the screen of the PDP, which is not enough to make the discharge occur, so no discharge occurs.

The first to fourth electrodes 110*a*, 110*b*, 111*a* and 111*b* can be the scan electrode, the sustain electrode and the transparent electrode formed on the front surface of the PDP.

Figure 9:
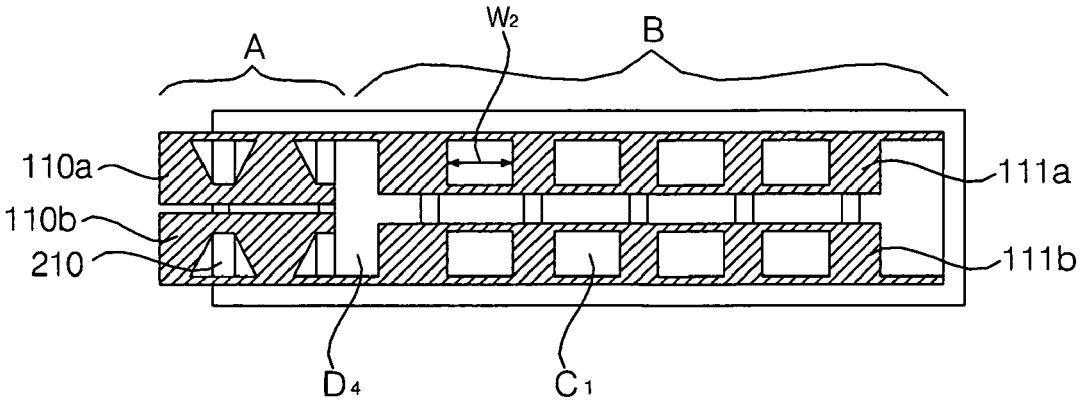
FIG. 9 illustrates a PDP in accordance with a sixth embodiment of the present invention.
Figure 10:
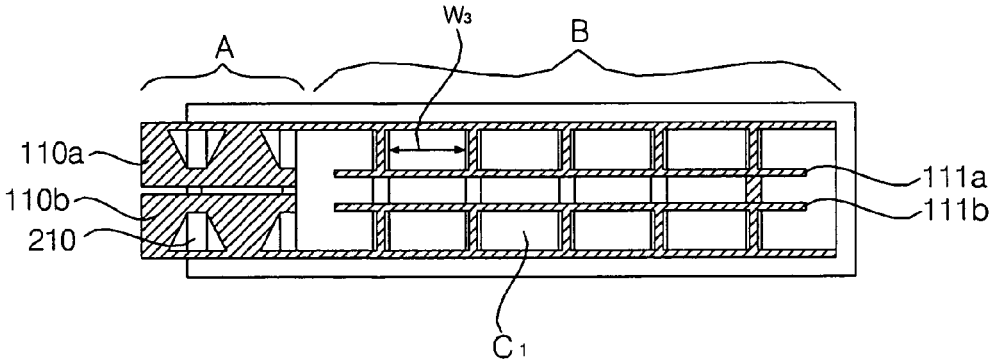
FIG. 10 illustrates a PDP in accordance with a seventh embodiment of the present invention.

FIG. 9 illustrates the structure of a PDP in accordance with a sixth embodiment of the present invention, and FIG. 10 illustrates the structure of a PDP in accordance with a seventh embodiment of the present invention.

As shown in FIGS. 9 and 10, openings ($C_1$) can be formed at a position facing a discharge cell of the third and fourth electrodes 111*a* and 111*b* formed at the non-valid screen (B).

In this case, respective horizontal widths ($W_2$ and $W_3$) of the openings can be larger or smaller than a horizontal width of a discharge cell ($D_4$) formed at the non-valid screen (B), so the shape of the opening ($C_1$) is not limited thereto.

When the openings ($C_1$) are formed at the discharge cell ($D_4$) of the third and fourth electrodes 111*a* and 111*b*, the area of the third and fourth electrodes 111*a* and 111*b* becomes smaller than that of the first and second electrodes 110*a* and 110*b*, so wall charges that can be collected at the third and fourth electrodes 111*a* and 111*b* can be limited.

In particular, the discharge formed at the side of the barrier ribs 210 spreads, so a weak discharge occurs or no discharge occurs at the discharge cell ($D_4$).

The first to fourth electrodes 110*a*, 110*b*, 111*a* and 111*b* can be the scan electrode, the sustain electrode and the transparent electrode formed on the front surface of the PDP.

Figure 11:
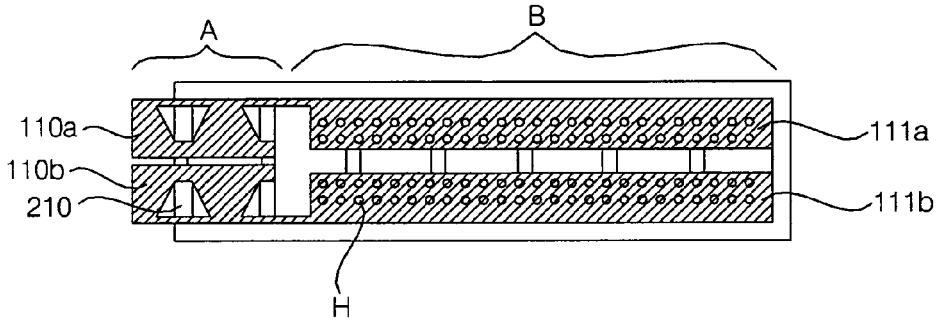
FIG. 11 illustrates a PDP in accordance with an eighth embodiment of the present invention.

FIG. 11 illustrates the structure of a PDP in accordance with an eighth embodiment of the present invention.

As shown in FIG. 11, a plurality of small holes (H) can be formed in the third and fourth electrodes 111*a* and 111*b* formed at the non-valid screen (B).

Since the third and fourth electrodes 111*a* and 111*b* are so thin, namely, having the thickness of 1000 Å~2000 Å, that surface resistance is formed in proportion to the area thereof. Thus, by forming the plurality of small holes (H) in the third and the fourth electrodes 111*a* and 111*b*, the area of the third and fourth electrodes 111*a* and 111*b* can be reduced, and accordingly, the surface resistance can be reduced.

The reduction of the surface resistance of the third and fourth electrodes 111*a* and 111*b* can lead to reduction of power consumption of the electrodes.

The first to fourth electrodes 110*a*, 110*b*, 111*a* and 111*b* can be the scan electrode, the sustain electrode and the transparent electrode formed on the front surface of the PDP.

Figure 12:
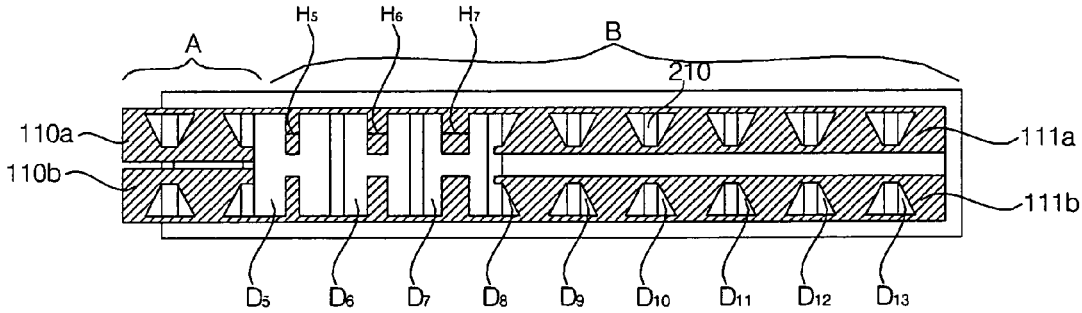
FIG. 12 illustrates a PDP in accordance with a ninth embodiment of the present invention.

FIG. 12 illustrates the structure of a PDP in accordance with a ninth embodiment of the present invention.

As shown in FIG. 12, horizontal widths ($H_5$, $H_6$ an $H_7$) can be increasingly larger as it goes toward the outer side of the PDP.

In this case, there is a high possibility that a discharge occurs at the first three discharge cells ($D_5$~$D_7$), among the discharge cells of the non-valid screen (B), which contact with the valid screen (A) as particles generated when the discharge occurs at the valid screen (A) are transferred thereto.

By constructing such that horizontal width ($H_5$~$H_7$) of the third and fourth electrodes 111*a* and 111*b* are not larger than 50% of respective horizontal widths of the discharge cells ($D_5$~$D_7$), the area of the third and fourth electrodes 111*a* and 111*b* can be reduced.

Likewise as in the fourth embodiment of the present invention, discharge cells ($D_8$~$D_{13}$) of the non-valid screen (B), excluding the discharge cells ($D_5$~$D_7$) contacting with the valid screen (A), include openings at portions of the third and fourth electrodes 111*a* and 111*b* where the barrier ribs 210 cross. Upper and lower end portions of the openings can be different in their horizontal width.

For example, the horizontal width ($H_5$) of the third and fourth electrodes 111*a* and 111*b* of the first discharge cell ($D_5$) of the non-valid screen (B) contacting with the valid screen (A) is 60 μm, and horizontal widths ($H_6$ and $H_7$) of the following discharge cells ($D_6$ and $D_7$) are 90 μm and 120 μm, respectively.

As for the other discharge cells, a horizontal width of an upper end portion of their electrodes can be 100 μm and a lower end portion thereof can be the same as the horizontal width of the discharge cells, namely, 150 μm~160 μm.

In other words, in the discharge cells ($D_5$~$D_7$) of the non-valid screen (B) much affected by the valid screen (A), the third and fourth electrodes 111*a* and 111*b* are formed with a smaller area to thereby limit wall charges compared with other discharge cells ($D_8$~$D_{13}$), so that they may not be affected by the discharge occurring at the valid screen (A).

At the same time, the electrodes near the exhaust tip (T) have the smaller area than the discharge cells contacting with the valid screen (A), so that more impurities can be adhered thereto.

Figure 13:
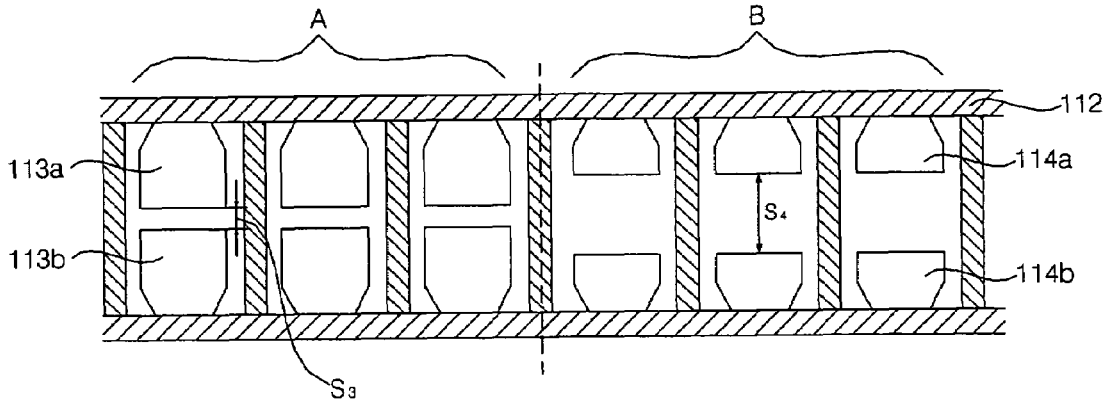
FIG. 13 illustrates a PDP in accordance with a tenth embodiment of the present invention.

FIG. 13 illustrates the structure of a PDP in accordance with a tenth embodiment of the present invention.

As shown in FIG. 13, a space ($S_4$) between third and fourth transparent electrodes 114*a* and 114*b* protruded from bus electrodes 112 formed side by side at the non-valid screen (B) is larger than a space ($S_3$) between first and second electrodes 113*a* and 113*b* protruded from the bus electrodes 112 of the valid screen (A).

In the case where the space ($S_4$) between the third and fourth transparent electrodes 114*a* and 114*b* of the non-valid screen (B) is larger than the space ($S_3$) between the first and second transparent electrodes 113*a* and 113*b* of the valid screen (A), a driving voltage required to make sure that a discharge occur properly must be increased.

In the PDP, discharges occur at both the non-valid screen (B) and the valid screen (A) during the aging process in which a high voltage is applied, and at this time, contaminants are induced toward the third and fourth transparent electrodes 114*a* and 114*b* of the non-valid screen (B).

Here, since the impurities are usually collected at the end of the electrodes, many impurities gather around the exhaust tip (T). In addition, when impurities are not completely exhausted during an exhausting process, the impurities which have not been exhausted during the exhausting process are adhered to the third and fourth transparent electrodes 114*a* and 114*b* of the non-valid screen (B) during the aging process.

Accordingly, in the case where the space ($S_4$) between the third and fourth transparent electrodes 114*a* and 114*b* of the non-valid screen (B) is larger than the space ($S_3$) between the first and second transparent electrodes 113*a* and 113*b* of the valid screen (A), the discharge occurs at the third and fourth transparent electrodes 114*a* and 114*b* only during the aging process.

The space between the third and fourth transparent electrodes 114*a* and 114*b* can be larger than the space between the first and second transparent electrodes 113*a* and 113*b*, by 1.2 times to 4 times.

That is, generally, the space between the first and second transparent electrodes 113*a* and 113*b* of the valid screen (A) is 60 μm~65 μm, so the space between the third and fourth transparent electrodes of the non-valid screen (B) can be 120 μm~180 μm.

Herein, if the space between the third and fourth transparent electrodes 114*a* and 114*b* of the non-valid screen (B) is smaller than 120 μm, undesirably, the discharge would occur at the non-valid screen (B) during the discharge of the panel, while if the space between the third and fourth transparent electrodes 114*a* and 114*b* is larger than 180 μm, since the discharge voltage is so high that, undesirably, the discharge could not occur at the third and fourth transparent electrodes 114*a* and 114*b* during the aging process.

Figure 14:
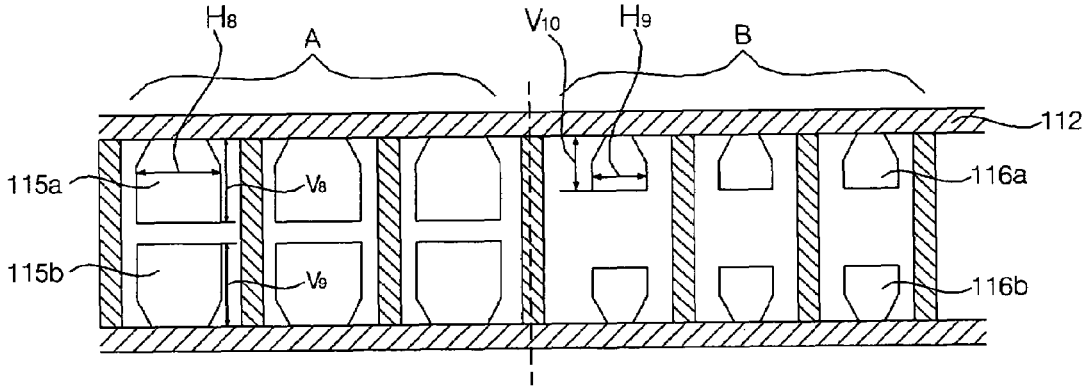
FIG. 14 illustrates a PDP in accordance with an eleventh embodiment of the present invention.

FIG. 14 illustrates the structure of a PDP in accordance with an eleventh embodiment of the present invention.

As shown in FIG. 14, a horizontal width ($H_9$) of third and fourth transparent electrodes 116*a* and 116*b* of the non-valid screen (B) can be smaller than a horizontal width ($H_8$) of the first and second transparent electrodes 115*a* and 115*b* of the valid screen (A), and a vertical width ($V_{10}$) of the third and fourth transparent electrodes 116*a* and 116*b* can be smaller than each of vertical widths ($V_8$ and $V_9$) of the first and second transparent electrodes 115*a* and 115*b*.

The vertical width ($V_8$) of the first transparent electrode 115*a* of the valid screen (A) is the same as the vertical width ($V_9$) of the second transparent electrode 115*b* of the valid screen (A).

When the horizontal width ($H_9$) and the vertical width ($V_{10}$) of the third and fourth transparent electrodes 116*a* and 116*b* are smaller than the horizontal width ($H_8$) and the vertical widths ($V_8$ and $V_9$) of the first and second transparent electrodes 115*a* and 115*b*, the area of the third and fourth transparent electrodes 116*a* and 116*b* becomes smaller than the area of the first and second transparent electrodes 115*a* and 115*b*.

Accordingly, when the PDP is actually driven, the relatively small amount of wall charges is accumulated at the third and fourth transparent electrodes 116*a* and 116*b* of the non-valid screen (B) compared with wall charges accumulated at the first and second transparent electrodes 115*a* and 115*b* of the valid screen (A).

Accordingly, a weak discharge occurs at the non-valid screen (B), which does not affect the screen display.

As described, above, in the PDP in accordance with the present invention, impurities which have not been exhausted through the exhaust tip (T) can be adhered onto the third and fourth electrodes 111*a* and 111*b* formed at the non-valid screen (B) during the aging process.

In addition, when the PDP is driven, the impurities which have not been exhausted can be prevented from being attached on the surface of a dielectric layer formed on the valid screen (A) and thus a loss of wall charges formed during the discharge can be prevented. Therefore, a discharge voltage can be stabilized and the discharge of the valid screen (A) can be strengthened.

In particular, since the space ($S_2$) between the third and fourth electrodes 111*a* and 111*b* of the non-valid screen (B) is larger than the space ($S_1$) between the first and second electrodes 110*a* and 110*b* of the valid screen (A), no discharge occurs at the non-valid screen (B) when the PDP is driven.

Moreover, since the area of the third and fourth electrodes 111*a* and 111*b* formed at the non-valid screen (B) is smaller than the area of the first and second electrodes 111*a* and 111*b* of the valid screen (A), even if the discharge occurs at the non-valid screen (B), accumulation of wall charges at the third and fourth electrodes 111*a* and 111*b* is limited, so the discharge occurring at the third and fourth electrodes 111*a* and 111*b* is too weak to affect the screen display.

The foregoing description of the preferred embodiments of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A plasma display panel having a display area and a non-display area positioned adjacent to the display area, comprising:

first and second electrodes formed to face each other at the display area with a first space formed therebetween;

third and fourth electrodes formed at the non-display area to face each other with a second space formed therebetween, the first space and second space being different; and a plurality of cells formed at the display area and the non-display area, and adjacent cells of the non-display area being separated by at least one barrier rib, wherein the second space between the third and fourth electrodes is wider than the first space between the first and second electrodes.

2. The panel of claim 1, wherein the second space between the third and fourth electrodes is wider than the first space between the first and second electrodes by at least 1.5 times.

3. The panel of claim 1, wherein a horizontal width of the third and fourth electrodes is smaller than that of the first and second electrodes.

4. The panel of claim 1, wherein the third and fourth electrodes have a different vertical width.

5. The panel of claim 1, wherein a first opening is formed at a position, corresponding to a discharge cell, of the third and fourth electrodes.

6. The panel of claim 5, wherein a horizontal width of the first opening is larger than that of the discharge cell.

7. The panel of claim 1, wherein a first opening is formed at a portion of the third and fourth electrodes where a barrier rib is formed.

8. The panel of claim 7, wherein a vertical width of an upper end portion of the first opening is different from that of a lower end portion thereof.

9. The panel of claim 1, wherein a horizontal width of the third and fourth electrodes increases toward an outer side of the non-display area.

10. The panel of claim 9, wherein the horizontal width of the third and fourth electrodes is not larger than the horizontal width of the discharge cell.

11. The panel of claim 1, wherein an area of the third and fourth electrodes increases toward the outer side of the non-display area.

12. A plasma display panel having a display area and a non-display area provided adjacent to the display area, wherein a width of first and second transparent electrodes formed to face each other at the display area is different from a width of third and fourth transparent electrodes formed to face each other at the non-display area, the non-display area having a plurality of discharge cells, wherein a horizontal width of the third and fourth transparent electrodes is smaller than that of the first and second transparent electrodes.

13. A plasma display panel comprising:

a first substrate;

scan electrodes and sustain electrodes in a first direction formed on the first substrate; wherein a first space between the scan electrodes and the sustain electrodes formed at a first area of the substrate is different from a second space between the scan electrodes and the sustain electrodes formed at a second area of the substrate;

a second substrate;

address electrodes formed on the second substrate in a second direction, the second direction being substantially perpendicular to the first direction; and a discharge cell formed at an area where the sustain and scan electrodes cross the address electrode, and adjacent discharge cells being separated by at least one barrier rib, wherein the first area corresponds to a display area and the second area corresponds to a non-display area, the discharge cells of the display area being configured for a discharge at a first driving voltage, and the discharge cells of the non-display area being configured for a discharge at a second driving voltage, the second driving voltage is higher than the first driving voltage by at least 20 volts, wherein the second space is wider than the first space by 1.2 times to 4 times the first space.

14. The panel of claim 13, wherein the second area is provided around a periphery of the first area.

15. The panel of claim 14, wherein the first space between the scan electrodes and the sustain electrodes formed at the first area is wider than the second space between the scan electrodes and sustain electrodes formed at the second area.

16. The panel of claim 13, wherein the scan electrodes and the sustain electrodes include transparent electrodes.

17. The panel of claim 16, wherein the first driving voltage is between 170V to 180V and the second driving voltage is at least 250V.

18. A plasma display panel comprising:

a first substrate;

a plurality of scan and sustain electrodes formed on the first substrate in a first direction;

a second substrate opposite of the first substrate;

a plurality of address electrodes formed on the second substrate in a second direction, which is substantially perpendicular to the first direction;

a plurality of discharge cells provided at locations where the scan and sustain electrodes cross the address electrodes; and a plurality of barrier ribs in at least one of the first direction or second direction, each barrier rib separating adjacent discharge cells, wherein a first group of the discharge cells is provided in a display area of the plasma display panel, and a second group of the discharge cells is provided in a non-display area of the plasma display panel, the non-display area is provided adjacent to the display area, and the scan electrode and the sustain electrode of the discharge cell in the display area is separated by a first prescribed distance in the second direction, and the scan electrode and the sustain electrode of the discharge cell in the non-display area is separated by a second prescribed distance in the second direction, the first and second distances being different;

wherein the first prescribed distance is less than the second prescribed distance.

19. The plasma display panel of claim 18, wherein the first group discharges at a first driving voltage and the second group discharges at a second driving voltage, the second driving voltage being higher than the first driving voltage.

20. The plasma display panel of claim 19, wherein the first driving voltage is between 170 volts to 180 volts, and the second driving voltage is at least 250 volts.

21. The plasma display panel of claim 18, wherein the second prescribed distance is at least 1.5 times greater than the first prescribed distance.

22. The plasma display panel of claim 18, wherein the scan electrode and the sustain electrode in the non-display area has a first length and a second length, respectively, in the second direction, and the first length is longer than the second length.

23. The plasma display panel of claim 22, wherein the scan electrode or the sustain electrode in the display area has a third length in the second direction, and the first length is longer than the third length.

24. The plasma display panel of claim 18, wherein a shortest width in the first direction of the scan electrode or the sustain electrode in the display area is wider than a widest width in the first direction of the scan electrode or the sustain electrode in the non-display area.

25. The plasma display panel of claim 18, wherein the scan and sustain electrodes in the non-display area have a plurality of holes.

26. The plasma display panel of claim 18, wherein at least one of scan electrode or sustain electrode of the discharge cell in the non-display area has an opening, the opening has a width in the first direction which is smaller or larger than a width of the discharge cell.

27. The plasma display panel of claim 18, wherein at least one of the scan electrode or sustain electrode of the discharge cell in the non-display area closest to the display area has a width in the first direction which is the smallest, and the width of at least one of the scan electrode or the sustain electrode in the non-display area increases as the discharge cell in the non-display area is further away from the display area.

* * * * *